US007403085B2

(12) United States Patent
Fukunaga et al.

(10) Patent No.: US 7,403,085 B2
(45) Date of Patent: Jul. 22, 2008

(54) RF MODULE

(75) Inventors: Tatsuya Fukunaga, Tokyo (JP); Masaaki Ikeda, Tokyo (JP); Kiyoshi Hatanaka, Tokyo (JP)

(73) Assignee: TDK Corporation, Tokyo (JP)

( * ) Notice: Subject to any disclaimer, the term of this patent is extended or adjusted under 35 U.S.C. 154(b) by 345 days.

(21) Appl. No.: 10/560,857

(22) PCT Filed: Mar. 31, 2004

(86) PCT No.: PCT/JP2004/004610

§ 371 (c)(1),
(2), (4) Date: Dec. 27, 2005

(87) PCT Pub. No.: WO2004/114454

PCT Pub. Date: Dec. 29, 2004

(65) Prior Publication Data

US 2006/0284704 A1 Dec. 21, 2006

(30) Foreign Application Priority Data

Jun. 24, 2003 (JP) ..... 2003-179368

(51) Int. Cl.

| | |
|---|---|
| ***H01P 5/12*** | (2006.01) |
| ***H01P 1/20*** | (2006.01) |
| ***H01P 7/10*** | (2006.01) |
| ***H01P 1/00*** | (2006.01) |
| ***H01P 3/00*** | (2006.01) |

(52) U.S. Cl. ..... 333/208; 333/127; 333/132; 333/135; 333/219.1; 333/239; 333/248

(58) Field of Classification Search ..... 333/12–129, 333/132, 134–137, 208, 219, 219.1, 227, 333/239, 248

See application file for complete search history.

(56) References Cited

U.S. PATENT DOCUMENTS

| | | | | |
|---|---|---|---|---|
| 5,512,868 | A * | 4/1996 | Takeda et al. | 333/219.2 |
| 5,982,256 | A * | 11/1999 | Uchimura et al. | 333/239 |
| 6,426,725 | B2 | 7/2002 | Hiroshima et al. | |
| 6,977,566 | B2 * | 12/2005 | Fukunaga | 333/208 |
| 6,992,548 | B2 * | 1/2006 | Fukunaga | 333/208 |
| 7,199,680 | B2 * | 4/2007 | Fukunaga | 333/26 |
| 7,227,428 | B2 * | 6/2007 | Fukunaga | 333/26 |

FOREIGN PATENT DOCUMENTS

| | | |
|---|---|---|
| EP | 1 300 908 A1 | 4/2003 |
| JP | A-03-077402 | 4/1991 |

(Continued)

*Primary Examiner*—Robert J. Pascal
*Assistant Examiner*—Kimberly E Glenn
(74) *Attorney, Agent, or Firm*—Oliff & Berridge, PLC

(57) ABSTRACT

The present invention provides an RF module capable of outputting balanced electromagnetic waves without requiring adjustment and easily realizing miniaturization. The RF module includes: a waveguide (3) having an area which is surrounded by a pair of ground electrodes (6) and (7) provided so as to face each other and through holes (8) for making electric conduction between the pair of ground electrodes (6) and (7) and in which electromagnetic waves in the TE mode can propagate and a one-wavelength resonator (11) is formed; and a pair of output lines (4*a*) and (4*b*) connected to portions corresponding to half-wavelength resonance regions (A) and (B) of the one-wavelength resonator (11) in the ground electrode (6).

10 Claims, 9 Drawing Sheets

FOREIGN PATENT DOCUMENTS

| | | |
|---|---|---|
| JP | A 04-287502 | 10/1992 |
| JP | A 06-053711 | 2/1994 |
| JP | B2-07-105645 | 11/1995 |
| JP | A 11-284409 | 10/1999 |
| JP | A 2000-091808 | 3/2000 |
| JP | A 2000-216605 | 8/2000 |
| JP | A-2001-274605 | 10/2001 |
| JP | A-2002-026610 | 1/2002 |
| JP | A-2002-026611 | 1/2002 |
| JP | A 2002-135003 | 5/2002 |
| JP | A 2002-246808 | 8/2002 |
| JP | A 2003-110307 | 4/2003 |

* cited by examiner

RF MODULE

TECHNICAL FIELD

The present invention relates to an RF module used for propagation of electromagnetic waves (RF signal) such as microwaves and millimeter waves.

BACKGROUND ART

In association with improvement in a mobile communication technique or the like, the frequency band of waves used for communication is being spread to a high-frequency area such as a GHz band and communication devices used for communication are also being miniaturized. RF modules such as a waveguide and a filter used in communication devices of this kind are also being requested to realize higher frequencies and further miniaturization. A waveguide line as disclosed in Japanese Patent Laid-open No. Hei 6-53711 and a filter using such a waveguide line as disclosed in Japanese Patent Laid-open No. Hei 11-284409 have been developed. As connection structures for connecting an RF module of this kind, connection structures as disclosed in Japanese Patent Laid-open Nos. 2000-216605 and 2003-110307 have been developed.

In this case, the waveguide line disclosed in Japanese Patent Laid-open No. Hei 6-53711 includes, as shown in FIG. 1 in the publication, a dielectric substrate (1) having conductor layers (2 and 3) and a plurality of conduction holes (4) which connect between the conductor layers (2 and 3) and are disposed in two lines. The waveguide line is constructed by a pseudo rectangular waveguide in which a region in the conductor is used as a line for transmitting a signal by surrounding all directions of a dielectric material with the pair of conductor layers (2 and 3) and pseudo conductive walls formed by the plurality of conduction holes (4). In this case, a waveguide line having such a configuration is also called a dielectric waveguide line.

The filter disclosed in Japanese Patent Laid-open No. Hei 11-284409 is constructed by, as shown in FIG. 1 in the publication, disposing a plurality of through conductors (26) forming an inductive window (coupling window) so as to establish electric connection (conduction) between a pair of main conductor layers (22 and 23) in a dielectric waveguide line (25) as a pseudo rectangular waveguide constructed by a dielectric substrate (21), the pair of main conductor layers (22 and 23) and a through conductor group (24) for sidewalls in a similar manner to the waveguide line disclosed in Japanese Patent Laid-open No. Hei 6-53711. Since the filter can be formed inside the dielectric substrate such as a wiring board, the filter can be easily miniaturized.

In a connection structure between a dielectric waveguide line (pseudo rectangular waveguide) and a line conductor (microstrip line) disclosed in the Japanese Patent Laid-open No. 2000-216605, as shown in FIG. 1 in the publication, an end of a line conductor (20) is inserted into an open end of a dielectric waveguide line (16), and the end and one main conductor layer (12) are electrically connected to each other via a line conductor (18) for connection and a through conductor (17) for connection so as to form steps. The connection structure is a so-called ridge waveguide structure in which the interval between the pair of main conductor layers (12 and 13) is narrowed. Therefore, at the time of propagation of RF signals (electromagnetic waves) from the line conductor (20) to the dielectric waveguide line (16), electromagnetic waves propagating in the TEM mode through the line conductor (20) are mode-converted into electromagnetic waves propagating in a TE mode ($TE_{10}$ mode) through the dielectric waveguide line (16).

On the other hand, in a connection structure between the waveguide line (in this example, the waveguide line is a component of a dielectric waveguide filter) and a line conductor (microstrip line) disclosed in the Japanese Patent Laid-open No. 2003-110307, as shown in FIG. 1 in the publication, protruding portions (17*a* and 17*b*) are formed on the outside of dielectric waveguide resonators (11*a* and 11*d*) forming a dielectric waveguide filter, and conductive strip lines (15*a* and 15*b*) extending from the bottom surfaces of the dielectric waveguide resonators (11*a* and 11*b*) to the protruding portions (17*a* and 17*b*) and serving as input and output electrodes are formed. The conductive strip lines (15*a*, 15*b*) are connected to conductive patterns (19*a* and 19*b*) as line conductors formed on a wiring board (18). In the connection structure, the conductive patterns (19*a* and 19*b*) are terminated on the bottom surfaces of the dielectric waveguide resonators (11*a* and 11*d*)-via the conductive strip lines (15*a* and 15*b*) formed so as to have the same width as that of the conductor patterns (19*a* and 19*b*). Thus, to the bottom surfaces of the dielectric waveguide resonators (11*a* and 11*d*), input and output signals in the TEM mode are supplied via the conductive patterns (19*a* and 19*b*), respectively. Therefore, magnetic fields generated in the dielectric waveguide resonators (11*a* and 11*d*) by the input and output signals are coupled to magnetic fields in a fundamental resonance mode (TE mode ($TE_{10}$ mode)) of the dielectric waveguide resonators (11*a* and 11*d*). As a result, electromagnetic waves propagating in the TEM mode in the conductive patterns (19*a* and 19*b*) are mode-converted into electromagnetic waves propagating in the TE mode ($TE_{10}$ mode) in the dielectric waveguide resonators (11*a* and 11*d*) as dielectric waveguide lines. Electromagnetic waves propagating in the TE mode ($TE_{10}$ mode) in the dielectric waveguide resonators (11*a* and 11*d*) are mode-converted into electromagnetic waves propagating in the TEM mode in the conductive patterns (19*a* and 19*b*).

Incidentally, for example, as disclosed in the Japanese Patent Laid-open Nos. 2000-216605 and 2003-110307, although most of RF modules currently proposed are to output electromagnetic waves in the TEM mode from the dielectric waveguide line (waveguide) as unbalanced electromagnetic waves, there is also a demand for realizing an RF module which outputs balanced RF signals in the TEM mode from a waveguide (unbalanced to balanced converter, so-called balun). To address the demand, for example, an RF module (dielectric filter) as disclosed in Japanese Patent Publication No. 3351351 has been proposed. In the dielectric filter, as shown in FIG. 1 in the publication, on an outer surface of a dielectric block (1), external terminal (8) continued from one end of an external coupling line (25) and an external terminal (6) generating capacitance in cooperation with a resonance line (5*a*) are formed, thereby constructing an unbalanced to balanced conversion circuit. The phase difference between one of output signals output from the external terminal (6) by the capacitive coupling and the other output signals output from the external terminal (8) by the inductive coupling is set to 180 degrees by adjusting a capacitance value and an inductance value of the coupled portions.

However, the unbalanced to balanced conversion circuit disclosed in the Japanese Patent Publication No. 3351351 has the following problems. In the unbalanced to balanced conversion circuit, in order to set the phase difference between the two output signals to 180 degrees, the capacitance value of the capacitive coupling and the inductance value of the inductive coupling have to be adjusted. Therefore, the unbalanced to balanced conversion circuit has the problems such that it requires some time and effort for the adjustment work and it is difficult to miniaturize the circuit since a signal path which is not operated as a resonator has to be provided in addition to a resonator.

DISCLOSURE OF INVENTION

The present invention has been achieved in consideration of such problems, and a main object of the invention is to provide an RF module capable of outputting balanced electromagnetic waves without requiring adjustment and, further, easily realizing miniaturization.

The RF module according to the invention to achieve the object includes: a waveguide having an area which is surrounded by a pair of ground electrodes and a conductor for making electrical connection between the pair of ground electrodes, the pair of ground electrode being provided so as to face each other, and in which electromagnetic waves in the TE mode can propagate and a one-wavelength resonator is formed; and a pair of output lines connected to portions corresponding to half-wavelength resonance regions of the one-wavelength resonator in one of the pair of ground electrodes.

In this case, preferably, the pair of output lines is formed so that electromagnetic waves in the TEM mode can propagate.

Preferably, the RF module further includes: a half-wavelength resonator formed inside the waveguide and coupled to the one-wavelength resonator; and an input line which is connected to a portion corresponding to the half-wavelength resonator in one of the pair of ground electrodes and through which electromagnetic waves in the TEM can be input as electromagnetic waves in the TE mode to the half-wavelength resonator. The half-wavelength resonator and the one-wavelength resonator can be coupled to each other via a waveguide or the like or directly.

In this case, it is preferable that the half-wavelength resonator and the one-wavelength resonator be coupled to each other via a coupling window.

Preferably, the RF module further includes at least one another resonator which is formed between the half-wavelength resonator and the one-wavelength resonator and coupled to both of the resonators via a coupling window.

Preferably, the RF module further includes: another one-wavelength resonator formed inside the waveguide and coupled to the one-wavelength resonator; and a pair of input lines which are connected to portions corresponding to half-wavelength resonance regions of the another one-wavelength resonator in one of the pair of ground electrodes and through which electromagnetic waves in the TEM mode can be input as electromagnetic waves in the TE mode to the another one-wavelength resonator. The another one-wavelength resonator and the one-wavelength resonator can be coupled to each other via a waveguide or the like or directly.

In this case, it is preferable that the another one-wavelength resonator and the one-wavelength resonator are coupled to each other via a coupling window.

Preferably, the RF module further includes at least one resonator formed between the another one-wavelength resonator and the one-wavelength resonator and coupled to both of the resonators via a coupling window.

The input line can be any one of a strip line, a microstrip line, and a coplanar line.

Further, the output line can be any one of a strip line, a microstrip line, and a coplanar line.

BEST MODE FOR CARRYING OUT THE INVENTION

A preferable embodiment of an RF module according to the invention will be described hereinbelow with reference to the attached drawings.

First, the configuration of the RF module according to the invention will be described with reference to the drawings.

Figure 1:
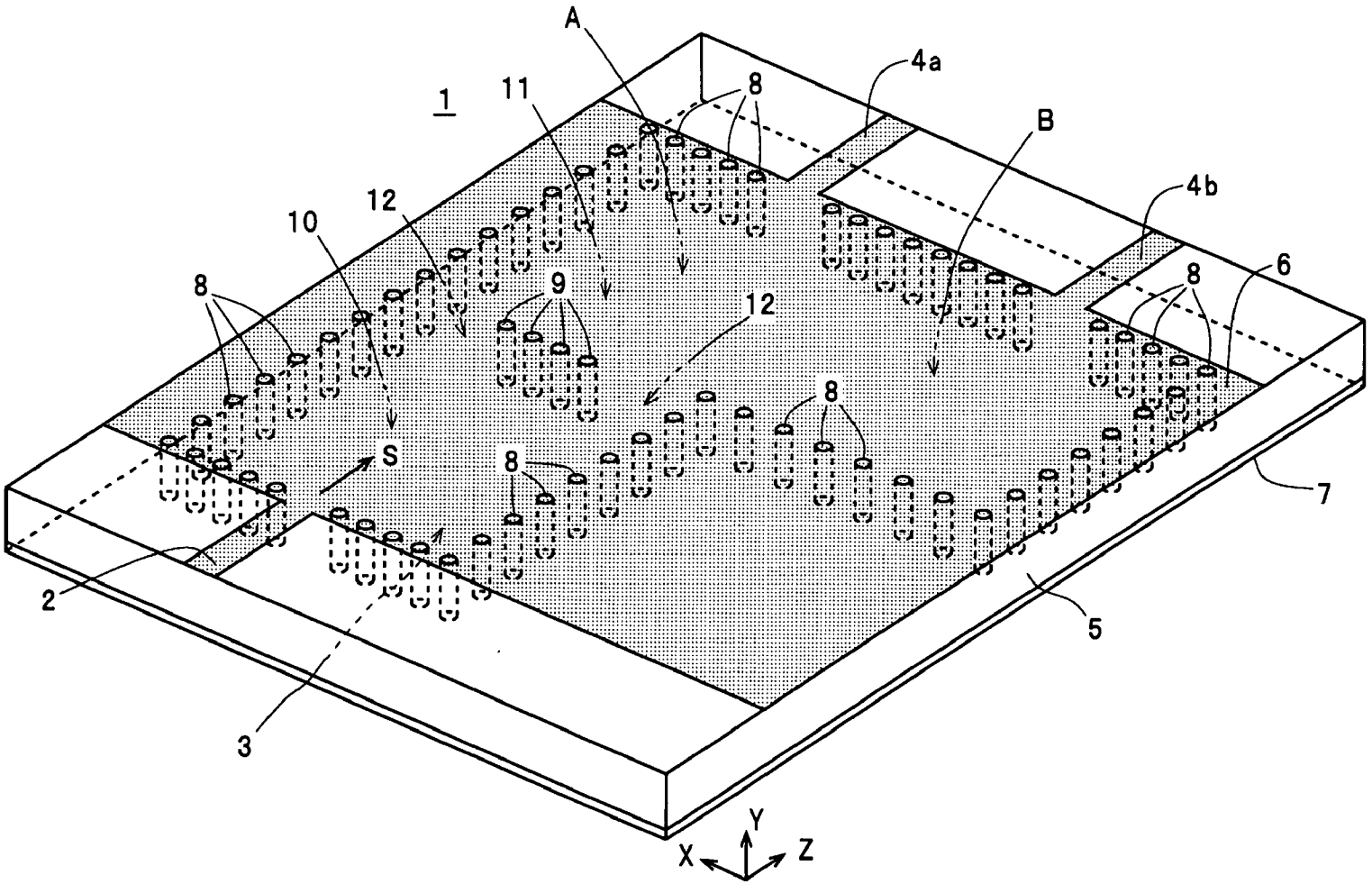
FIG. 1 is a perspective view showing the configuration of an RF module 1 according to an embodiment.

As shown in FIG. 1, an RF module 1 includes an input line 2 through which electromagnetic waves in the TEM mode propagate, a waveguide 3 which is coupled to the input line 2 and through which electromagnetic waves in the TE mode (concretely, $TE_{10}$ mode of the lowest order) propagate, and a pair of output lines 4*a* and 4*b* which are coupled to the waveguide 3 and through which electromagnetic waves in the TEM mode propagate. In this case, the waveguide 3 forms a dielectric waveguide (dielectric waveguide line) by including a pair of ground electrodes 6 and 7 disposed to face each other while sandwiching a dielectric substrate 5, and a plurality of through holes 8 penetrating the dielectric substrate 5 to make electric conduction between the pair of ground electrodes 6 and 7, thereby functioning as a conductor in the invention. The through holes 8, whose inner face is metallized, are disposed at intervals each equal to or less than a predetermined width (for example, a width of one fourth of the guide signal wavelength) in order to prevent leakage of the electromagnetic waves propagating the waveguide 3. With this configuration, the waveguide 3 enables the electromagnetic waves to propagate, for example, in an S direction in the diagram without leaking in an area surrounded by the pair of ground electrodes 6 and 7, and the through holes 8. The waveguide 3 can be a dielectric waveguide filled with dielectric as in the embodiment or, although not shown, a cavity waveguide whose inside is cavity. In FIG. 1, the uppermost layer is hatched and is shown with thickness omitted.

Figure 2:
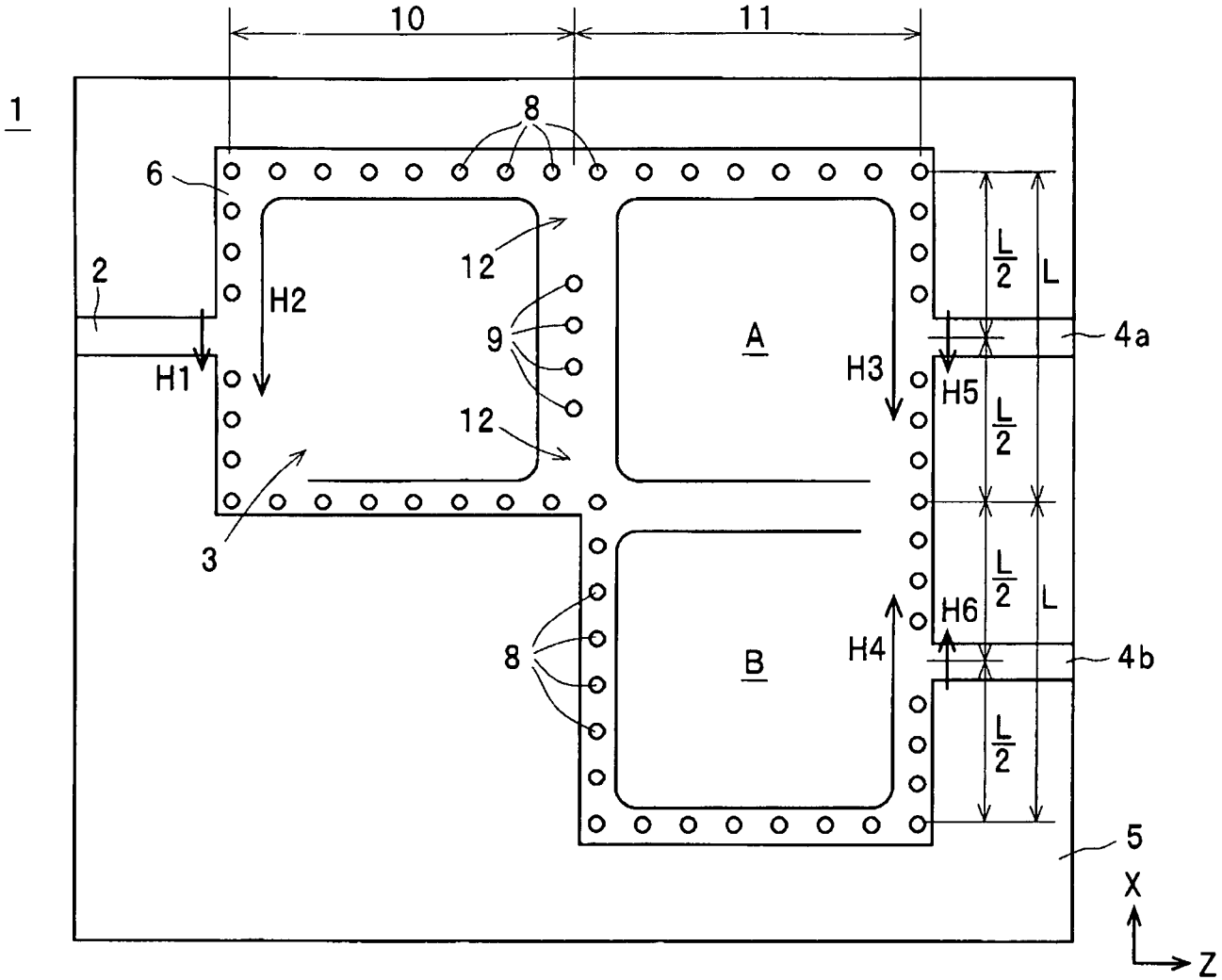
FIG. 2 is a plan view of the RF module 1.

As shown in FIG. 1, in the waveguide 3, a plurality of other through holes 9 for making electrical conduction between the pair of ground electrodes 6 and 7 are provided in a line by penetrating the dielectric substrate 5. In this case, the through holes 9 are formed in the same structure as that of the through holes 8 described above. Therefore, as shown in FIGS. 1 and 2, in the waveguide 3, coupling windows 12 are formed in spaces between the through holes 9 and the through holes 8. A half-wavelength resonator 10 is formed on the input side of the waveguide 3 and a one-wavelength resonator 11 is formed on the output side. The half-wavelength resonator 10 is magnetically coupled to a half-wavelength resonance region A out of the half-wavelength resonance regions A and B in the one-wavelength resonator 11 via the coupling windows 12. Therefore, the RF module 1 is constructed so as to function as a filter (concretely, a bandpass filter). As an example, the waveguide 3 is constructed by disposing the half-wavelength resonator 10 and the one-wavelength resonator 11 so that the general shape in plan view becomes an L shape. Alternately, the waveguide 3 may be constructed by disposing the half-wavelength resonator 10, the half-wavelength resonance region A in the one-wavelength resonator 11, and the half-wavelength resonator B in the one-wavelength resonator 11 on a straight line so that the general shape in plan view becomes an I shape. Moreover, a plurality of half-wavelength resonators 10 may be formed in multiple stages in the waveguide 3.

As shown in FIG. 1, the input line 2 is disposed on a surface on which the ground electrode 6 is formed of the dielectric substrate 5 so as to face the ground electrode 7 while sandwiching the dielectric substrate 5, thereby constructing a microstrip line. One end side of the input line 2 is directly connected and conducted to a part corresponding to the half-wavelength resonator 10 in the ground electrode 6 (in other words, a part in which the half-wavelength resonator 10 is constructed). With the configuration, the input line 2 is magnetically coupled to the waveguide 3 on an E plane (a plane parallel with an electric field) of the waveguide 3. In this case, the propagation mode in the waveguide 3 is the TE mode and the electromagnetic waves propagate in the S direction (that is, the Z direction), so that the E plane of the waveguide 3 is a plane parallel with an XY plane of FIG. 1.

Figure 3:
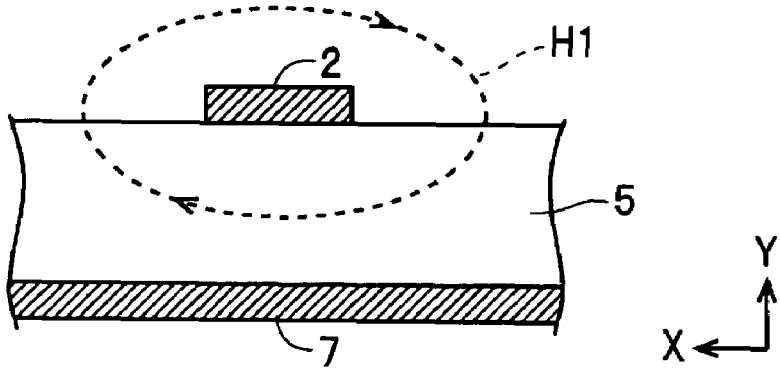
FIG. 3 is an explanatory drawing showing the magnetic field distribution of a magnetic field H1 around a connection part to a waveguide 3 in an input line 2 of the RF module 1.
Figure 4:
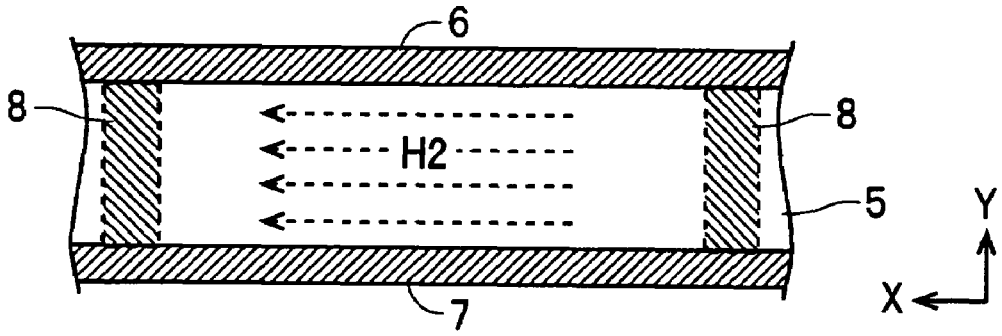
FIG. 4 is an explanatory drawing showing the magnetic field distribution of a magnetic field H2 around a connection part to the input line 2 in the waveguide 3 of the RF module 1.
Figure 5:
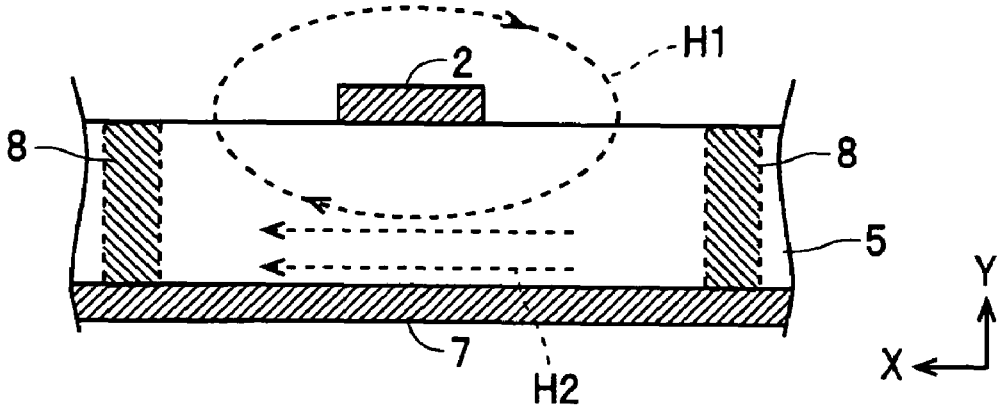
FIG. 5 is an explanatory drawing showing the magnetic field distribution (coupling state) of the magnetic fields H1 and H2 in the connection parts to the input line 2 and the waveguide 3, respectively, in the RF module 1.

FIGS. 3 to 5 show magnetic field distributions in the XY cross section in and around a connection part between the input line 2 and the waveguide 3. In this case, a magnetic field H1 in the input line 2 in the neighborhood of the connection part distributes annularly around the input line 2 as shown in FIG. 3 since the propagation mode of the electromagnetic waves is the TEM mode. On the other hand, a magnetic field H2 in the waveguide 3 distributes in one direction in the cross section as shown in FIG. 4 since the propagation mode of the electromagnetic waves is the TE mode ($TE_{10}$ mode). Therefore, as shown in FIG. 5, in the E plane of the waveguide 3 in the connection part, the direction of the magnetic field H1 in the input line 2 coincides with that of the magnetic field H2 in the waveguide 3. Consequently, the input line 2 and the waveguide 3 are magnetically coupled to each other, so that the conversion from the TEM mode to the TE mode is executed. That is, the electromagnetic waves in the TEM mode propagating from the input line 2 are supplied into the waveguide 3 as the electromagnetic waves in the TE mode.

The pair of output lines 4*a* and 4*b* is disposed on the surface on which the ground electrode 6 is formed in the dielectric substrate 5 so as to face the ground electrode 7 while sandwiching the dielectric substrate 5 as shown in FIG. 1, thereby constructing microstrip lines in a manner similar to the input line 2. One end sides of the output lines 4*a* and 4*b* are directly connected and conducted to parts corresponding to the half-wavelength resonance regions A and B in the one-wavelength resonator 11 in the ground electrode 6. Concretely, as shown in FIG. 2, when the length of each of the half-wavelength resonance regions A and B of the one-wavelength resonator 11 is L, the output line 4*a* is connected to the center portion of the half-wavelength resonance region A (the position apart from the end of the half-wavelength resonance region A only by L/2), and the output line 4*b* is connected to the center portion of the half-wavelength resonance region B (the position apart from the end of the half-wavelength resonance region B only by L/2). Consequently, in a manner similar to the input line 2, when the direction of the magnetic field H3 in the half-wavelength resonance region A of the one-wavelength resonator 11 coincides with that of a magnetic field H5 in the output line 4*a* and the direction of a magnetic field H4 in the half-wavelength resonance region B of the one-wavelength resonator 11 coincides with that of a magnetic field H6 in the output line 4*b*, the output lines 4*a* and 4*b* are magnetically coupled to the waveguide 3 in an E plane (plane parallel with the XY plane in FIG. 1) of the waveguide 3. Therefore, in connection parts between the pair of output lines 4*a* and 4*b* and the waveguide 3, in a manner opposite to that in the case of the input line 2, the conversion from the TE mode to the TEM mode is executed.

Next, the operation of the RF module 1 will be described.

Figure 6:
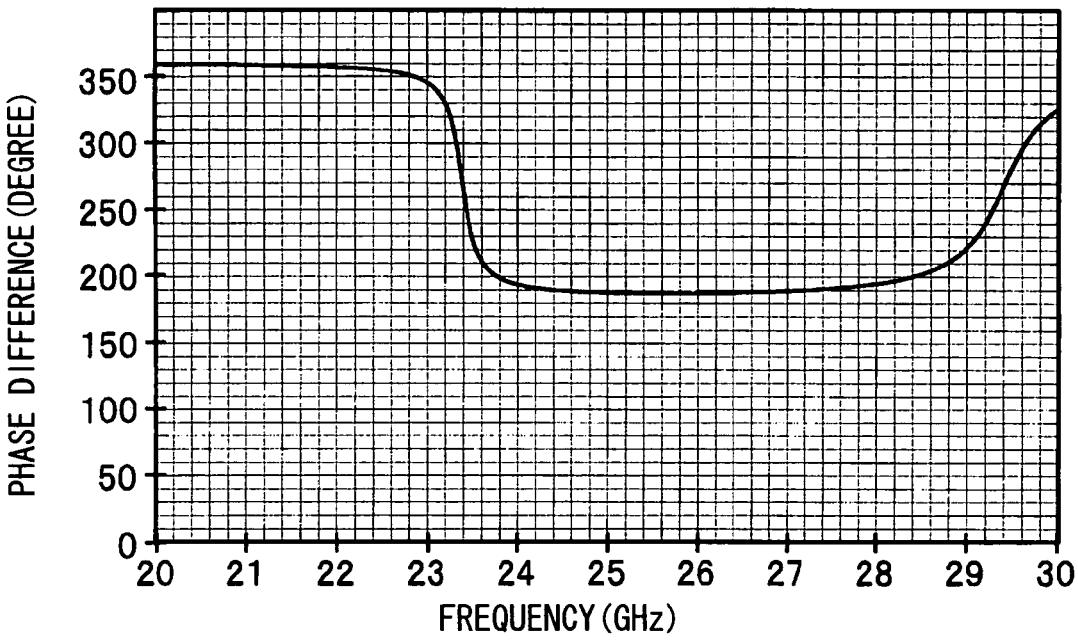
FIG. 6 is a characteristic diagram showing the relation between the frequency and the phase difference in the RF module 1.

In the RF module 1, electromagnetic waves in the TEM mode supplied to the input line 2 are supplied as electromagnetic waves in the TE mode to the half-wavelength resonator 10 and, further, propagate to the one-wavelength resonator 11 via the half-wavelength resonator 10. In this case, as schematically shown in FIG. 2, the directions of the magnetic fields H3 and H4 generated in an H plane in the half-wavelength resonance regions A and B of the one-wavelength resonator 11 (plane parallel with the magnetic field, that is, plane parallel with the XY plane) are always opposite to each other in a frequency band where the one-wavelength resonator 11 acts as a resonator on electromagnetic waves (a signal passband of the RF module 1). Therefore, the directions of the magnetic fields H5 and H6 in the output lines 4*a* and 4*b* connected to the half-wavelength resonance regions A and B, respectively, are also always opposite to each other in the signal passband. As a result, the phases of the electromagnetic waves in the TEM mode output from the one-wavelength resonator 11 to the output lines 4*a* and 4*b* are shifted from each other almost by 180 degrees in the signal passband. According to the result of a simulation, in the RF module 1, as shown in FIG. 6, the phase difference between the electromagnetic waves output from the output lines 4*a* and 4*b* is almost constant in a range from 180 degrees to 190 degrees in a wider frequency band (a band from about 24.5 GHz to about 26.5 GHz) including the signal passband (a band from about 25 GHz to about 25.4 GHz). Therefore, the electromagnetic waves in the TEM mode converted to be balanced are output from the pair of output lines 4*a* and 4*b*. That is, the RF module 1 also functions as an unbalanced to balanced converter.

Figure 7:
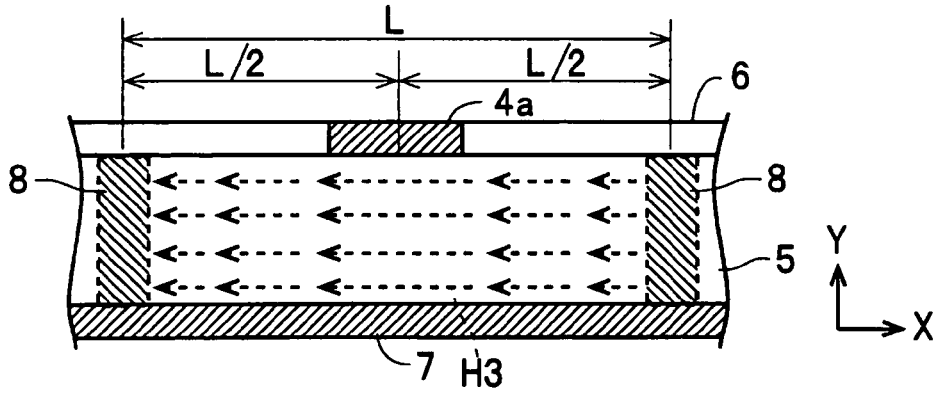
FIG. 7 is an explanatory drawing showing the intensity distribution of a magnetic field H3 around a connection part to an output line 4*a* in the waveguide 3 in the RF module 1.
Figure 8:
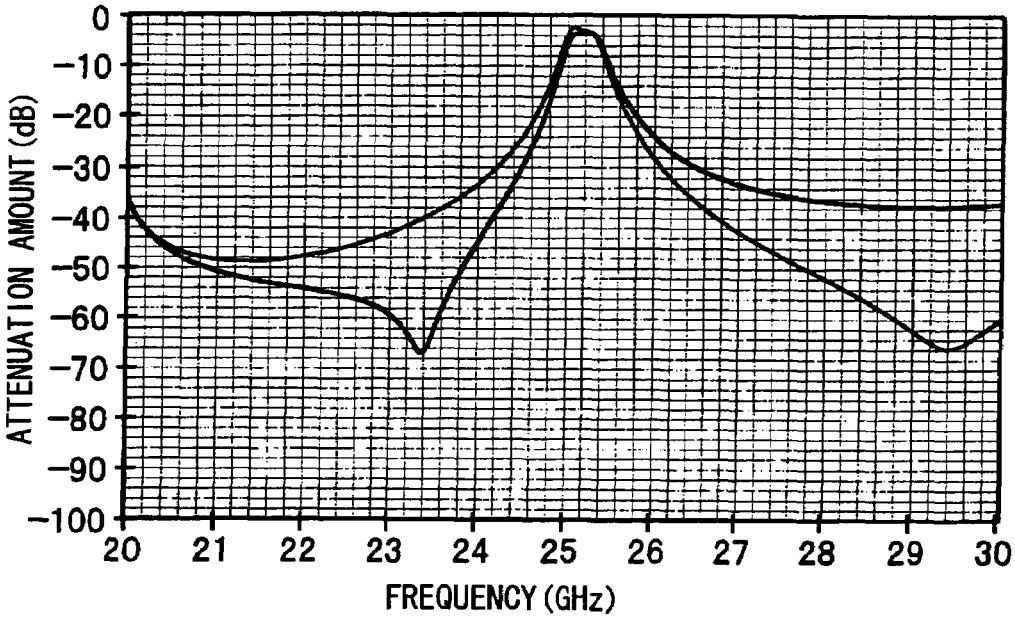
FIG. 8 is a characteristic diagram showing the relation between the frequency and the attenuation rate in the RF module 1.

On the other hand, as shown in FIG. 7, the intensity distribution of the magnetic field H3 in the E plane to which the output line 4*a* in the half-wavelength resonance region A is connected is the widest in the center portion and becomes narrower toward the ends in the longitudinal direction (the X or Z direction) of the half-wavelength resonance region A (in the diagram, the intensity of the magnetic field H3 is expressed by the length of an arrow). In the thickness direction (Y direction) of the half-wavelength resonance region A, the intensity distribution of the magnetic field H3 in the E plane is almost uniform as shown in FIG. 7. The intensity distributions in the half-wavelength resonance region B are similar to the above and, moreover, the output lines 4*a* and 4*b* are connected in almost the same positions in the half-wavelength resonance regions A and B in the same one-wavelength resonator 11 (portions which are almost symmetrical to each other with respect to the coupling plane as a center in which the half-wavelength resonance regions A and B are coupled to each other, that is, the almost center portions in the X direction in this example). Consequently, the intensity distributions of the magnetic fields H3 and H4 in the E plane to which the output lines 4*a* and 4*b* are connected are almost the same. Therefore, the magnetic fields H5 and H6 of the output lines 4*a* and 4*b* magnetically coupled to the magnetic fields H3 and H4, respectively, always have also almost the same intensity in the signal passband where the one-wavelength resonator 11 acts as a resonator for electromagnetic waves. As a result, the intensities of the electromagnetic waves in the TEM mode output from the output lines 4*a* and 4*b* via one-wavelength resonator 11 are almost the same. Therefore, the balanced electromagnetic waves in the TEM mode whose magnitudes are balanced (having the same magnetic field intensity) are output from the pair of output lines 4*a* and 4*b*. According to the result of the simulation, in the RF module 1, as shown in FIG. 8, the intensities (attenuation amounts) of the electromagnetic waves output from the pair of output lines 4*a* and 4*b* almost coincide with each other in the signal passband. The magnitude balance of the balanced electromagnetic waves in the TEM mode output from the pair of output lines 4*a* and 4*b* can be adjusted by changing the positions of connection to the half-wavelength resonance regions A and B of the output lines 4*a* and 4*b*.

As described above, in the RF module 1, the one-wavelength resonator 11 is formed on the output side in the waveguide 3 having the area which is surrounded by the pair of ground electrodes 6 and 7 disposed so as to face each other and the plurality of through holes 8 through which the pair of ground electrodes 6 and 7 are conducted to each other, and constructed so that the electromagnetic waves in the TE mode can propagate, and the output lines 4*a* and 4*b* are connected to the portions corresponding to the half-wavelength resonance regions A and B of the one-wavelength resonator 11 in the ground electrodes 6 as one of the pair of ground electrodes 6 and 7. Consequently, the phase difference between the electromagnetic waves output from the output lines 4*a* and 4*b* can be made almost 180 degrees without adjustment. Therefore, while realizing a simple configuration, the RF module 1 can convert electromagnetic waves in the TE mode propagating through the waveguide 3 into balanced electromagnetic waves in the TEM mode without adjustment and output the electromagnetic waves in the TEM mode.

In the RF module 1, the half-wavelength resonator 10 coupled to the one-wavelength resonator 11 via the coupling windows 12 is formed in the waveguide 3, and the input line 2 is connected to the portion corresponding the half-wavelength resonator 10 in the ground electrode 6 as one of the ground electrodes. With the configuration, the electromagnetic waves in the TEM mode input from the input line 2 are converted into the balanced electromagnetic waves in the TEM mode, and the balanced electromagnetic waves in the TEM mode can be output from the pair of output lines 4*a* and 4*b*. Therefore, the RF module 1 can function as a so-called balun.

Figure 9:
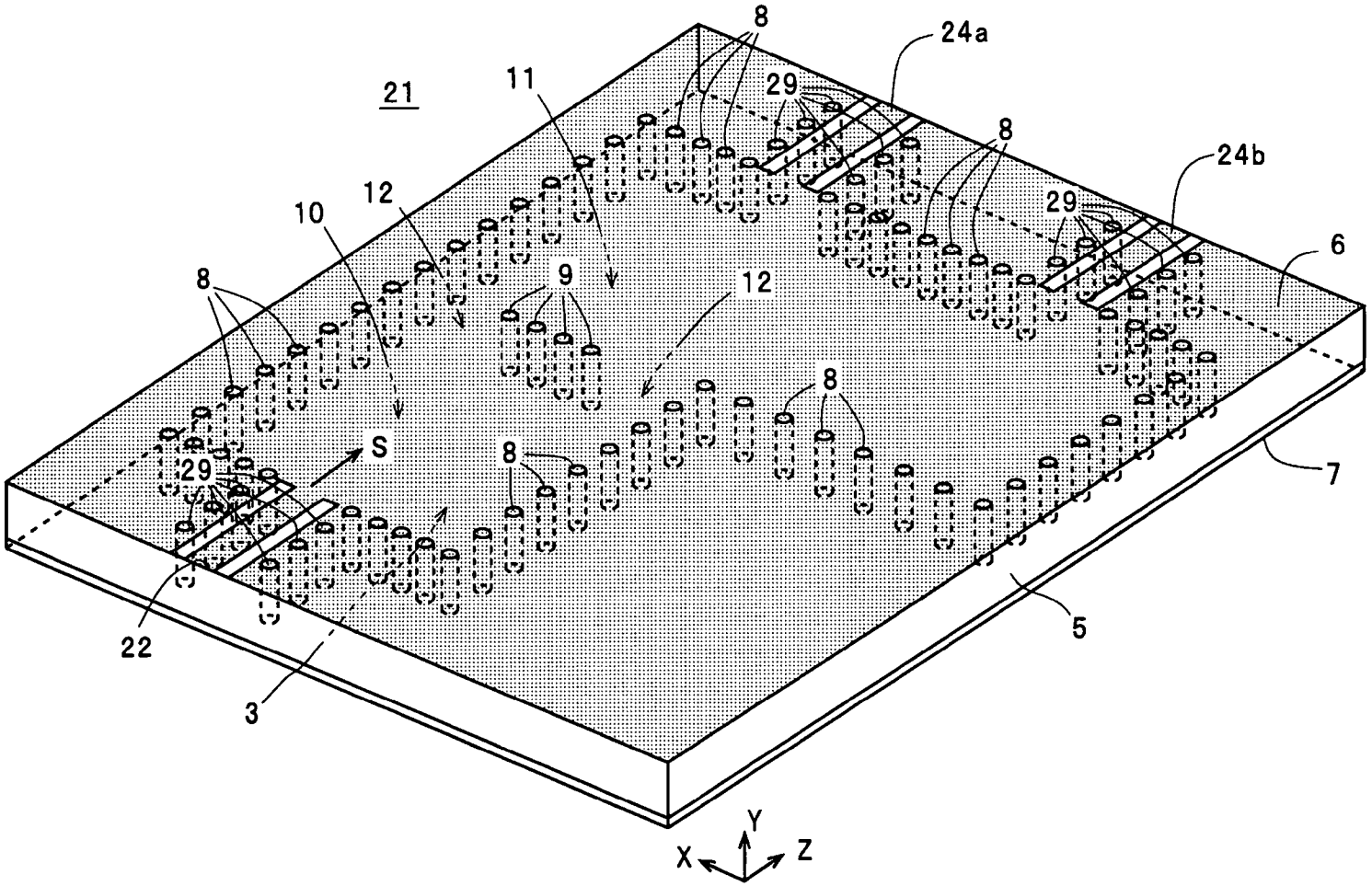
FIG. 9 is a perspective view showing the configuration of an RF module 21 according to the embodiment of the invention.

The invention is not limited to the embodiment described above. For example, although the embodiment of the invention has been described by an example in which the input line 2 and the pair of output lines 4*a* and 4*b* are formed by microstrip lines, as in an RF module 21 shown in FIG. 9, an input line 22 and a pair of output lines 24*a* and 24*b* can be formed by coplanar lines. As shown in the diagram, the basic configuration of the RF module 21 is almost the same as that of the RF module 1 only except for the input line 22 and the pair of output line 24*a* and 24*b* employed in place of the input line 2 and the output lines 4*a* and 4*b*, respectively. In FIG. 9, the same reference numerals are designated to the components same as those in the RF module 1. The uppermost layer is hatched and is shown with thickness omitted.

In the case, the input line 22 is formed so as to face the ground electrode 7 while sandwiching the dielectric substrate 5 and be surrounded by the ground electrode 6 on the surface on which the ground electrode 6 is formed in the dielectric substrate 5. One end side of the input line 22 is directly connected and conducted to a part corresponding to the half-wavelength resonator 10 in the ground electrode 6. The ground electrode 6 surrounding the input line 22 is conducted to a facing part in the ground electrode 7 via a plurality of through holes 29 (having the same structure as that of the through holes 8 and 9) which penetrate the dielectric substrate 5, are in parallel with the input line 22, and are provided on both sides of the input line 22. With this configuration, the input line 22 functions as a coplanar line. Each of the pair of the output lines 24*a* and 24*b* is formed in a manner similar to the input line 22 and functions as a coplanar line.

Figure 10:
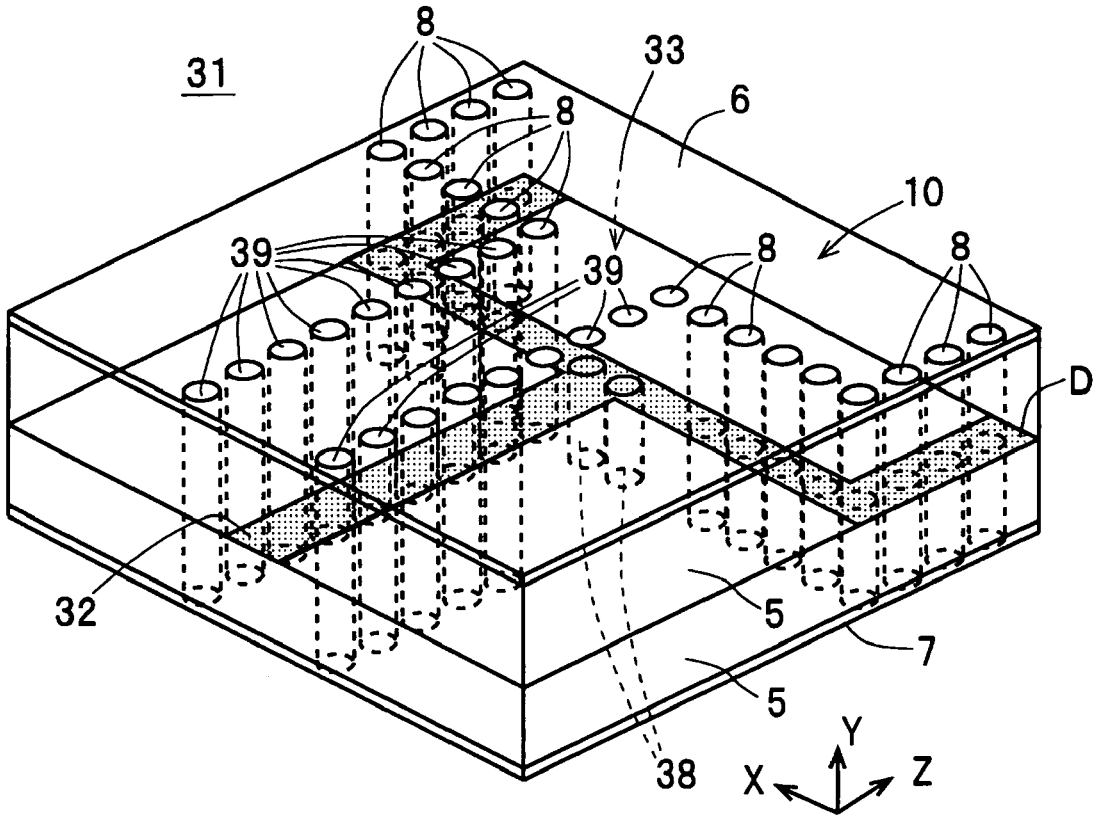
FIG. 10 is a perspective view showing the configuration of an input line 32 and a connection part between the input line 32 and the waveguide 33 in the RF module 31 according to the embodiment of the invention.

The foregoing embodiment has been described by using the configuration as an example in which the input line 2 and the pair of the output lines 4*a* and 4*b* or the input line 22 and the pair of output lines 24*a* and 24*b* are provided on the surface on which the ground electrode 6 is formed in the dielectric substrate 5 so as to be directly connected to the ground electrode 6. It is also possible to construct an RF module by using a dielectric substrate having the ground electrodes 6 and 7 on the top and under faces and another conductive layer as an intermediate portion between the ground electrodes 6 and 7 and by forming an input line and a pair of output lines by the conductive layer in the intermediate portion. Referring to FIG. 10, the configuration of a connection part between an input line and a waveguide of an RF module 31 shown in the diagram will be described. In FIG. 10, to facilitate understanding of the configuration of the connection part, part of the through holes 8 positioned on the front side of through holes 38 which will be described later is omitted, and the one-wavelength resonator 11 and a pair of output lines are omitted. In the diagram, the conductor layer D as an intermediate layer is hatched and is shown with thickness omitted.

Figure 11:
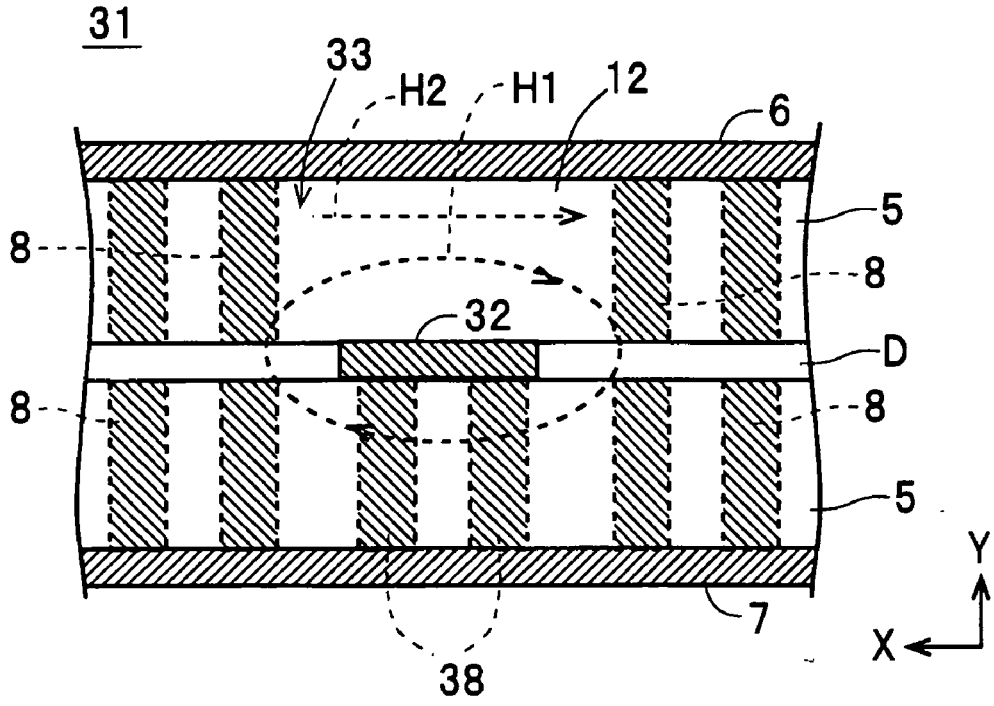
FIG. 11 is an explanatory drawing showing the magnetic field distribution (coupling state) of the input line 32 and the waveguide 33 in the RF module 31.

In the RF module 31, two dielectric substrates 5 are stacked via the conductor layer D. The ground electrode 6 is formed on the surface of one of the dielectric substrates 5 (the top face of the dielectric substrate 5 on the upper side in FIG. 10), and the other ground electrode 7 is formed on the surface of the other dielectric substrate 5 (the under face of the dielectric substrate 5 on the lower side in FIG. 10). The grand electrodes 6 and 7 are conducted to each other through the plurality of through holes 8 penetrating the two dielectric substrates 5 and the conductor layer D. The conductor layer D surrounded by the plurality of through holes 8 is removed as shown in FIG. 10. As a result, a waveguide 33 is formed by the ground electrodes 6 and 7 and the through holes 8. An input line 32 is formed by a strip line by using the conductor layer D. As shown in FIGS. 10 and 11, one end side of the input line 32 is conducted only to the ground electrode 7 via the other through holes 38. The input line 32 is sandwiched by a plurality of through holes 39 through which the ground electrodes 6 and 7 are conducted to each other in a manner similar to the through holes 8 and which are provided on both sides of the input line 32. With this configuration, the input line 32 functions as a coplanar line.

In the RF module 31, as shown in FIG. 11, the magnetic field H1 of the input line 32 through which the electromagnetic waves in the TEM mode propagate is distributed annularly around the input line 32. In this case, since the through holes 38 through which the input line 32 is conducted to the ground electrode 7 exist on one end side of the input line 32, a region in which the through holes 38 do not exist (the upper-side area in FIG. 11) functions as a coupling window 12. Therefore, the direction of the magnetic field H1 in the input line 32 on the E plane of the waveguide 33 and that of the magnetic field H2 in the waveguide 33 coincide with each other. Consequently, the input line 32 and the waveguide 33 are magnetically coupled to each other, thereby performing conversion from the TEM mode to the TE mode. Although it is not shown, a pair of output lines is also formed in a manner similar to the input line 32. Electromagnetic waves in the TE mode of the one-wavelength resonator (not shown) formed in the waveguide 33 are converted into balanced electromagnetic waves in the TEM mode, and the electromagnetic waves in the TEM mode are output.

Figure 12:
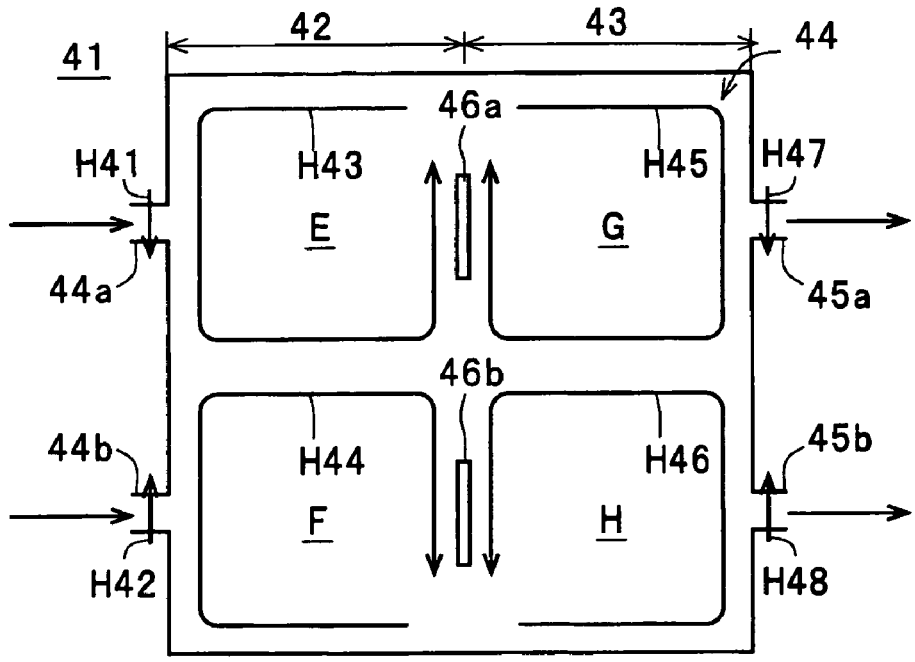
FIG. 12 is a schematic diagram showing the configuration of an RF module 41 according to the embodiment of the invention.

In the foregoing embodiments, the RF modules 1, 21, and 31 have been described, which convert electromagnetic waves in the TEM mode input from one input line 2 (22 or 32) into the balanced electromagnetic waves in the TEM mode and output the balanced electromagnetic waves in the TEM mode from the pair of output lines 4*a* and 4*b* (or 24*a* and 24*b*) by forming the one-wavelength resonator 11 on the output side of the waveguide 3 or 33 and forming the half-wavelength resonator 10 on the input side. Alternately, like an RF module 41 schematically shown in FIG. 12, a balanced-input to balanced-output type RF module (for example, a filter) can be also constructed by forming one-wavelength resonators 42 and 43 on both of the input side and the output side of a waveguide 44. In this case, an input line 44*a* is provided in a half-wavelength resonance region E of the one-wavelength resonator 42 disposed on the input side and the other input line 44*b* is provided in a half-wavelength resonance region F of the one-wavelength resonator 42. An output line 45*a* is provided in a half-wavelength resonance region G of the one-wavelength resonator 43 provided on the output side and the other output line 45*b* is provided in a half-wavelength resonance region H of the one-wavelength resonator 43. A coupling window 46*a* for coupling the regions E and G is disposed between the half-wavelength resonance region E of the one-wavelength resonator 42 and the half-wavelength resonance region G of the one-wavelength resonator 43. A coupling window 46*b* for coupling the regions F and H is disposed between the half-wavelength resonance region F of the one-wavelength resonator 42 and the half-wavelength resonance region H of the one-wavelength resonator 43.

In the RF module 41, one electromagnetic wave (magnetic field H41) which is input to the input line 44*a* as one of the input lines of the one-wavelength resonator 42 and forms a balanced electromagnetic wave in the TEM mode is output as an electromagnetic wave in the TEM mode (magnetic field H47) to the output line 45*a* via the half-wavelength resonance region E (magnetic field H43 in the region) of the one-wavelength resonator 42, the coupling window 46*a*, and the half-wavelength resonance region G (magnetic field H45 in the region) of the one-wavelength resonator 43. On the other hand, the other electromagnetic wave (magnetic field H42) which is input to the input line 44*b* of the one-wavelength resonator 42 and forms an electromagnetic wave in the TEM mode is output as an electromagnetic wave in the TEM mode (magnetic field H48) to the output line 45*b* via the half-wavelength resonance region F of the one-wavelength resonator 42 (magnetic field H44 in the region), the coupling window 46*b*, and the half-wavelength resonance region H (magnetic field H46 in the region) of the one-wavelength resonator 43. Therefore, the RF module 41 functions as a balanced-input to balanced-output typed filter.

Figure 13:
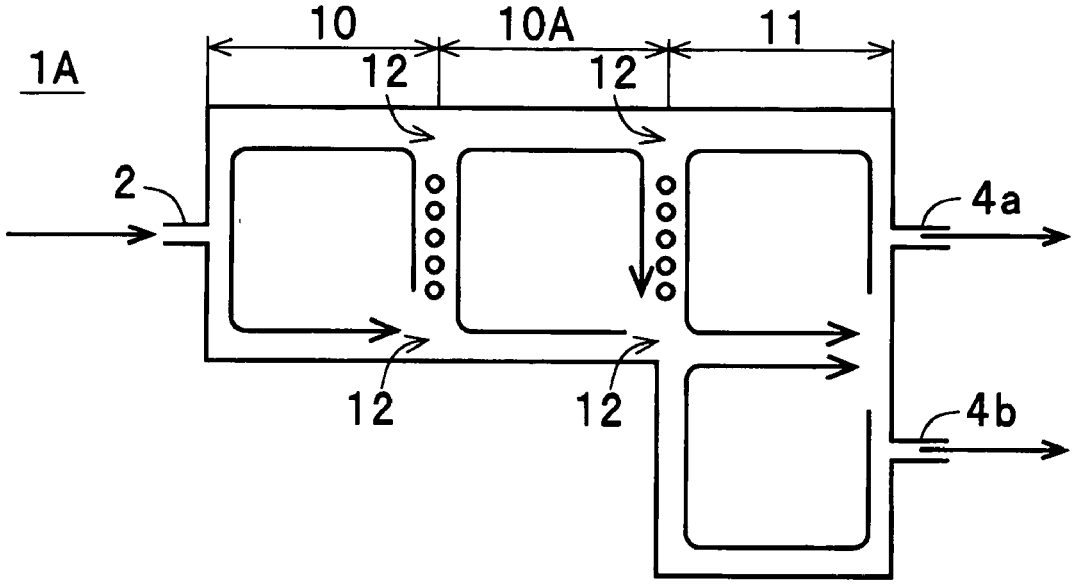
FIG. 13 is a schematic diagram showing the configuration of an RF module 1A according to the embodiment of the invention.

The RF module 1 in which the half-wavelength resonator 10 is formed on the input side of the waveguide 3, the one-wavelength resonator 11 is formed on the output side, and the half-wavelength resonator 10 and the one-wavelength resonator 11 are coupled to each other via the coupling windows 12 has been described as an example. However, the invention is not limited to the configuration. For example, as shown in FIG. 13, an RF module 1A includes at least one (in the diagram, one as an example) another resonator (a half-wavelength resonator 10A whose basic operation is the same as that of the half-wavelength resonator 10) which is formed between the half-wavelength resonator 10 and the one-wavelength resonator 11 and coupled to both of the resonators 10 and 11 via the coupling windows 12. The another RF module 21 can be also similarly constructed by disposing other resonators (one-wavelength resonator and half-wavelength resonator) between the half-wavelength resonator 10 and the one-wavelength resonator 11 via coupling windows. The adoption of the configurations enables the RF module to function as a filter of various frequency characteristics.

Figure 14:
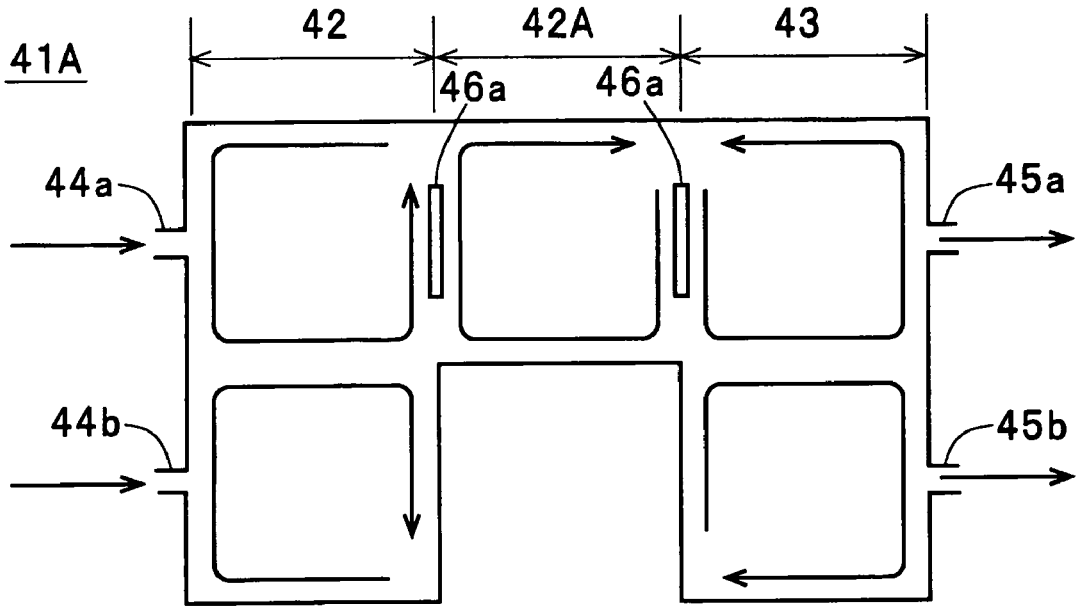
FIG. 14 is a schematic diagram showing the configuration of an RF module 41A according to the embodiment of the invention.

The RF module 41 in which the one-wavelength resonators 42 and 43 are formed on the input side and the output side, respectively, of the waveguide 44 and both of the one-wavelength resonators 42 and 43 are directly coupled to each other via the coupling windows 46*a* and 46*b* has been described above. However, the invention is not limited to the configuration. For example, it is sufficient that the one-wavelength resonators 42 and 43 are disposed at least on the input side and output side of the waveguide 44. As shown in FIG. 14, the RF module 41A includes at least one (for example, one in the diagram) another resonator (in the diagram, as an example, the half-wavelength resonator 42A whose basic operation is the same as that of the half-wavelength resonator 10) which is formed between the one-wavelength resonator 42 (another one-wavelength resonator) and the one-wavelength resonator 43 and coupled to both of the resonators 42 and 43 via the coupling windows 46*a* and 46*b*. The adoption of this configuration also enables the RF module to function as a filter of various frequency characteristics.

In the RF module 1 (or 21) described above, both of the input line 2 (or 22) and the pair of the output lines 4*a* and 4*b* (or 24*a* and 24*b*) are formed on the surface on which the ground electrode 6 is formed in the dielectric substrate 5. However, the input line 2 (or 22) and the pair of output lines 4*a* and 4*b* (or 24*a* and 24*b*) do not always have to be formed on the same surface in the dielectric substrate 5. For example, although it is not shown, another configuration may be employed in which the input line 2 (or 22) is formed on the side of the ground electrode 6 in the dielectric substrate 5 and the pair of output lines 4*a* and 4*b* (or 24*a* and 24*b*) is formed on the side of the ground electrode 7 in the dielectric substrate 5. A configuration in which the components are disposed on the opposite sides may be also employed. Further, the embodiments have been described in which one kind out of a strip line, a microstrip line, and a coplanar line is uniformly used for the input lines and the output lines. However, it is sufficient to use one kind for the input lines and another kind for the output lines and therefore, input lines and output lines can be also formed of a mutually different kind of lines. For example, it is possible to use microstrip lines as the input lines and use coplanar lines as the pair of output lines.

As described above, the RF module according to the invention includes: the waveguide having the area which is surrounded by the pair of ground electrodes provided to face each other and the conductors through which the pair of ground electrodes are conducted to each other, and in which electromagnetic waves in the TE mode can propagate and the one-wavelength resonator is formed; and the pair of output lines which are connected to portions corresponding to half-wavelength resonance regions of the one-wavelength resonator in one of the pair of ground electrodes. Consequently, in the signal passband, the phase difference between electromagnetic waves output from the output lines can be set to almost 180 degrees without adjustment. As a result, the RF module does not require the adjustment between a capacitance value of capacitative coupling and an inductance value of inductive coupling while realizing a simpler configuration in comparison with RF modules of the related art. Since the adjustment work can be made unnecessary and it is not necessary to provide a signal path which is not operated as a resonator in addition to the resonator, the RF module can be sufficiently miniaturized. By constructing the pair of output lines so that electromagnetic waves in the TEM mode can propagate, adjustment is unnecessary and balanced electromagnetic waves in the TEM mode can be output from the pair of output lines.

The RF module according to the invention includes the half-wavelength resonator formed inside the waveguide and coupled to the one-wavelength resonator, and the input line which is connected to the portion corresponding to the half-wavelength resonator in one of the pair of ground electrodes and through which electromagnetic waves in the TEM mode can be input as electromagnetic waves in the TE mode to the half-wavelength resonator. Consequently, the electromagnetic waves in the TEM mode input from the input line can be converted into balanced electromagnetic waves in the TEM mode, and the balanced electromagnetic waves in the TEM mode can be output from the pair of output lines. That is, the RF module can function as a so-called balun. In this case, the half-wavelength resonator and the one-wavelength resonator can be coupled to each other via the coupling window.

The RF module according to the invention includes, between the half-wavelength resonator and the one-wavelength resonator, at least one another resonator coupled to both of the resonators via the coupling window. Consequently, the RF module which can function as a filter of various frequency characteristics can be provided.

The RF module according to the invention includes another one-wavelength resonator formed inside the waveguide and coupled the one-wavelength resonator, and the pair of input lines which are connected to the portions corresponding to the half-wavelength resonance regions of the other one-wavelength resonator in one of the pair of ground electrodes and through which the electromagnetic waves in the TEM mode can be input as the electromagnetic waves in the TE mode to the other one-wavelength resonator. Consequently, the balanced electromagnetic waves in the TEM mode can be output as the balanced electromagnetic waves in the TEM mode. In this case, the other one-wavelength resonator and the one-wavelength resonator can be coupled to each other via the coupling window.

The RF module according to the invention includes, between the other one-wavelength resonator and the one-wavelength resonator, at least one another resonator which is coupled to both of the resonators via the coupling window. Consequently, the RF module which can function as a filter of various frequency characteristics can be provided.

What is claimed is:

1. An RF module comprising:

a waveguide having an area which is surrounded by a pair of ground electrodes and a conductor for making electrical connection between the pair of ground electrodes, the pair of ground electrodes being provided so as to face each other, and in which electromagnetic waves in the TE mode can propagate and a one-wavelength resonator is formed; and a pair of output lines connected to portions corresponding to half-wavelength resonance regions of the one-wavelength resonator in one of the pair of ground electrodes.

2. The RF module according to claim 1, wherein the pair of output lines is formed so that electromagnetic waves in the TEM mode can propagate.

3. The RF module according to claim 1, comprising:

a half-wavelength resonator formed inside the waveguide and coupled to the one-wavelength resonator; and an input line which is connected to a portion corresponding to the half-wavelength resonator in one of the pair of ground electrodes and through which electromagnetic waves in the TEM can be input as electromagnetic waves in the TE mode to the half-wavelength resonator.

4. The RF module according to claim 3, wherein the half-wavelength resonator and the one-wavelength resonator are coupled to each other via a coupling window.

5. The RF module according to claim 3, further comprising at least one another resonator which is formed between the half-wavelength resonator and the one-wavelength resonator and coupled to both of the resonators via a coupling window.

6. The RF module according to claim 3, wherein the input line is any one of a strip line, a microstrip line, and a coplanar line.

7. The RF module according to claim 1, further comprising:

another one-wavelength resonator formed inside the waveguide and coupled to the one-wavelength resonator; and a pair of input lines which are connected to portions corresponding to half-wavelength resonance regions of the another one-wavelength resonator in one of the pair of ground electrodes and through which electromagnetic waves in the TEM mode can be input as electromagnetic waves in the TE mode to the another one-wavelength resonator.

8. The RF module according to claim 7, wherein the another one-wavelength resonator and the one-wavelength resonator are coupled to each other via a coupling window.

9. The RF module according to claim 7, further comprising at least one resonator formed between the another one-wavelength resonator and the one-wavelength resonator and coupled to both of the resonators via a coupling window.

10. The RF module according to claim 1, wherein the output line is any one of a strip line, a microstrip line, and a coplanar line.

* * * * *